US005203265A

United States Patent [19]

Nii et al.

[11] Patent Number: 5,203,265

[45] Date of Patent: Apr. 20, 1993

[54] SELF-PROPELLING, MULTI-ROUTE TRANSPORT FOR MOVEMENT ALONG BOTH HORIZONTAL AND VERTICAL SECTIONS OF TRACK

[76] Inventors: Koichi P. Nii, 1376 E. 27 St., Oakland, Calif. 94606; Shizuo Harada, Nerima-ku Minami Tanaka 5-7-16, Tokyo, Japan

[21] Appl. No.: 691,861

[22] Filed: Apr. 26, 1991

[51] Int. Cl.[5] ..... B61C 11/02

[52] U.S. Cl. ..... 105/29.1; 104/94; 104/127; 104/230; 105/149

[58] Field of Search ..... 104/89, 94, 127, 172.1, 104/172.4, 230; 105/29.1, 73, 77, 96, 127, 148, 149; 187/12, 1 R

[56] References Cited

U.S. PATENT DOCUMENTS

| | | | |
|---|---|---|---|
| 1,470,935 | 10/1923 | Rush . | |
| 2,700,345 | 1/1955 | Cox | 105/29.1 |
| 3,226,027 | 12/1965 | Cable et al. | 105/29.1 X |
| 3,340,821 | 9/1967 | Wesener | 105/29.1 X |
| 3,487,789 | 1/1970 | Garner | 104/94 X |
| 3,497,089 | 2/1970 | Forster et al. | 104/94 X |
| 3,517,775 | 6/1970 | Meyer | 187/12 |
| 3,525,306 | 8/1970 | Edel et al. | 105/149 |
| 3,831,714 | 8/1974 | Hedman et al. | 187/12 |
| 3,967,699 | 7/1976 | Jasch | 187/2 |
| 4,004,654 | 1/1977 | Hamy | 105/149 X |
| 4,235,475 | 11/1980 | Monks | 104/172.1 |
| 4,254,710 | 3/1981 | Guay | 105/29.1 X |
| 4,368,037 | 1/1983 | Limque et al. | 105/29.1 X |
| 4,656,799 | 4/1987 | Maryon | 52/236.3 |
| 4,736,557 | 4/1988 | Maryon | 52/236.3 |
| 4,821,845 | 4/1989 | DeViaris | 197/12 |

FOREIGN PATENT DOCUMENTS 0291678 5/1987 European Pat. Off. .

OTHER PUBLICATIONS

High Speed Trains; Jane Collins; Cartwell Books 1978; pp. 60–61.

Sky Scraping; Doug Stewart; Sep. 1988; pp. 47–56.

310–MPH Flying Trains; David Scott and John Free; May 1989, pp. 132–135; 159.

*Primary Examiner*—Robert J. Oberleitner
*Assistant Examiner*—S. Joseph Morano
*Attorney, Agent, or Firm*—Bielen, Peterson & Lampe

[57] ABSTRACT

A self-propelling transport having utility as an elevator system in a high rise building, the transport having a vehicle unit that rides on a track unit that includes a stationary drive chain that is engaged by a sprocket wheel assembly on the vehicle unit, the vehicle unit having a suspended passenger cab and a propulsion unit that engages the chain to retain the vehicle unit against the track during movement with the drive chain being magnetically retained on the track unit by electromagnets that are demagnetized where the drive chain is engaged by the sprocket wheel assembly.

20 Claims, 7 Drawing Sheets

FIG-1
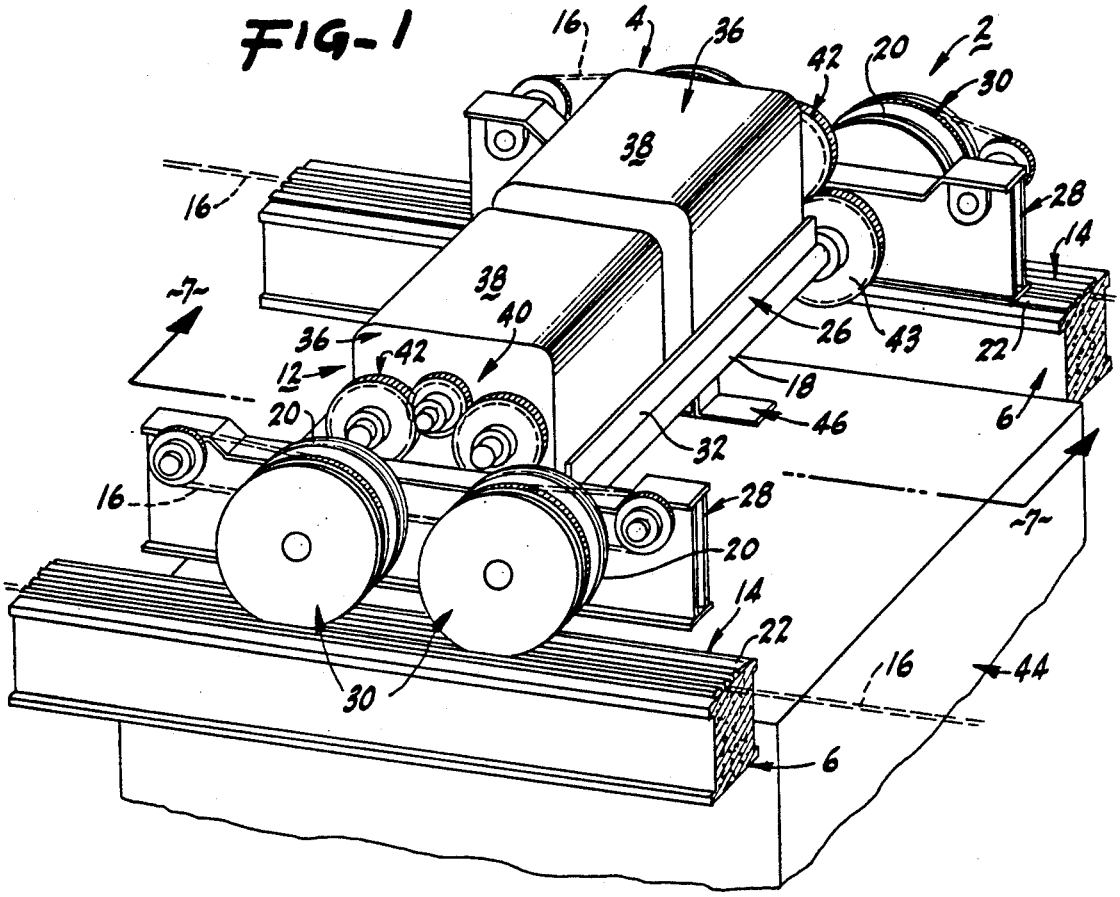
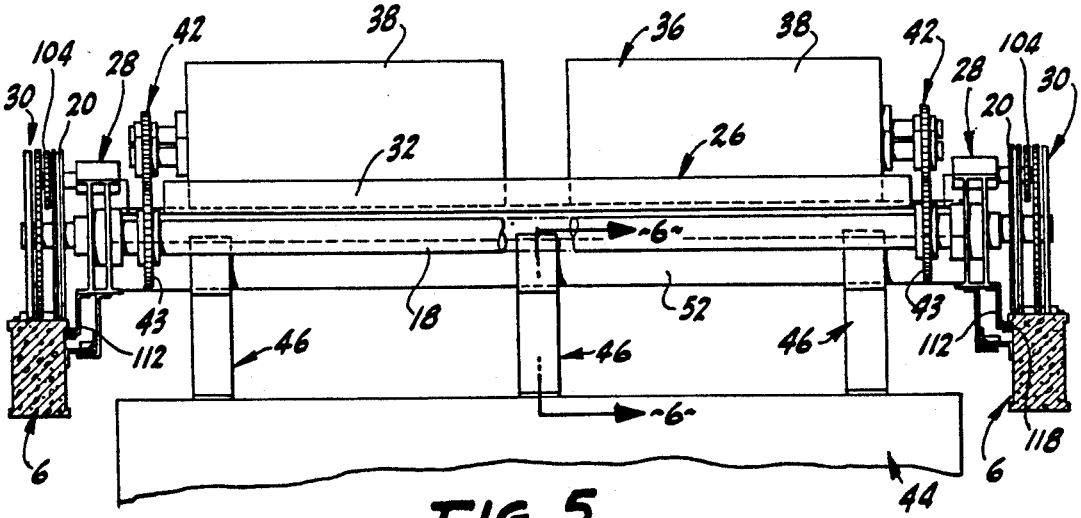
FIG-5

FIG-14
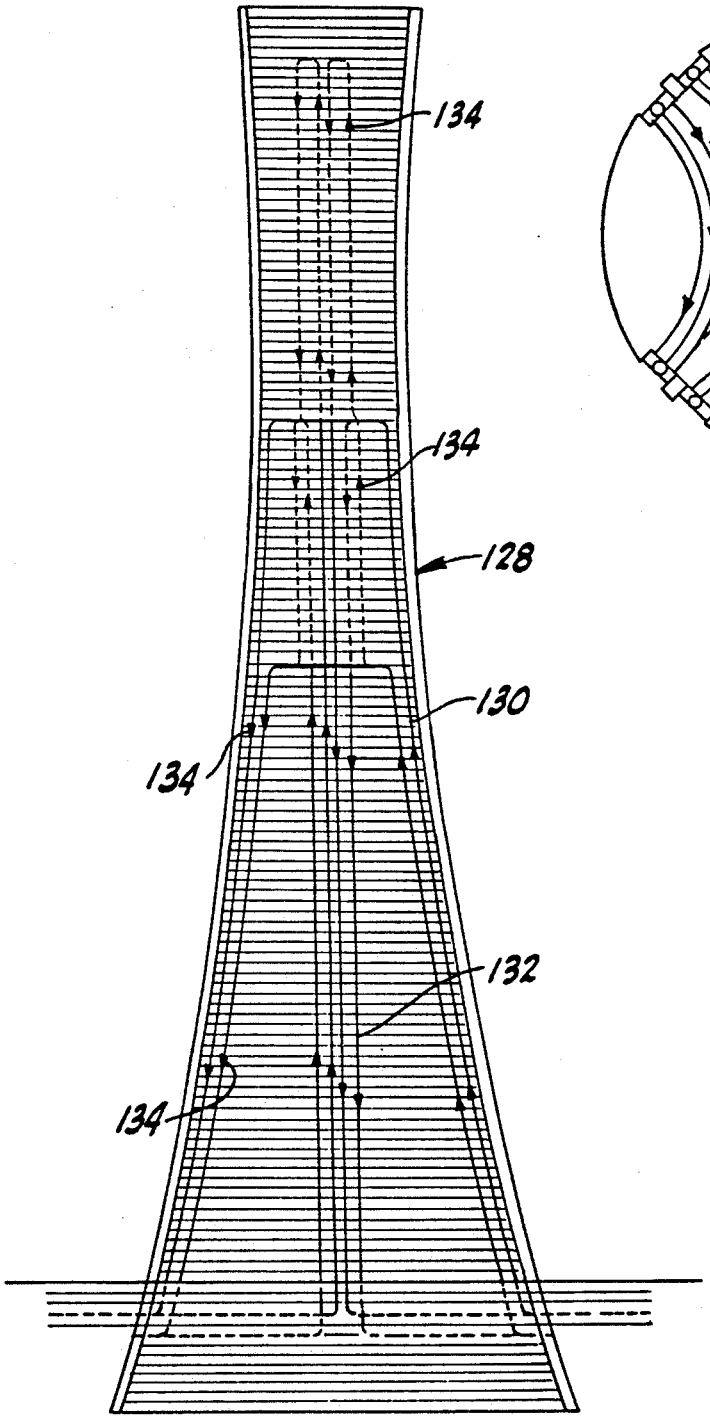
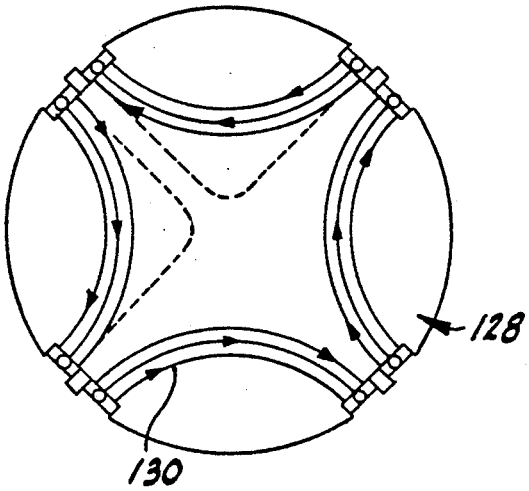
FIG-15
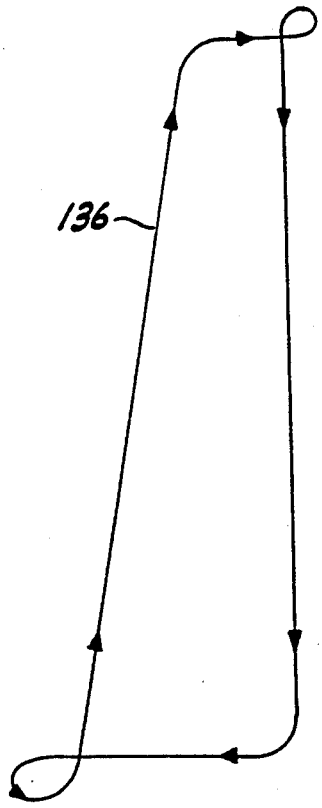
FIG-16

SELF-PROPELLING, MULTI-ROUTE TRANSPORT FOR MOVEMENT ALONG BOTH HORIZONTAL AND VERTICAL SECTIONS OF TRACK

BACKGROUND OF THE INVENTION

This invention relates to a transport of the type that includes both a track unit and a vehicle unit interconnected by a drive chain. The vehicle unit is designed to include a compartment or a cab for transport of cargo or individuals and is particularly suited for high rise buildings that exceed a hundred floors in height. The vehicle unit is designed to transport the compartment or cab along a track that may vary from horizontal, vertical, or inclined with the compartment maintaining a ground aligned orientation. Because of the desirability of utilizing the transport as a passenger carrying system, additional features are included such as a gyroscope to maintain the correct orientation for passenger comfort. In its preferred use as a passenger transport for tall buildings, the system is adaptable to building designs that have other than customary vertical shaft systems that limit the design and construction of the building itself.

In ultra tall buildings, the internal transportation system becomes extremely complexed. Sufficient transport vehicles be provided to access the numerous floors, creating problems of design of express systems and local systems. The height itself causes structural problems in conventional cable systems. For example, after a large number of floors, the weight of the cable itself becomes a burden. Additionally, since the maximum speed of comfortable travel is limited to approximately 20 miles per hour, the conventional approach is to use a greater number of lower floor elevators, including express elevators to what is conveniently called a sky lobby, where patrons transfer to secondary elevator systems for accessing higher floors. The time necessary to travel to upper floors increase dramatically.

The improved transport of this invention is feasible for use in a variety of situations, such as in deep shaft mining where combinations of horizontal, inclined and vertical travel is desired or in a more sophisticated use as a passenger transport system in multi-floor buildings where a number of floors makes impracticable conventional systems. Although prior art self propelled vehicle systems have been proposed for use in environments as contemplated herein, such systems have not fully satisfied the criteria of safety and stability that render them suitable for such varied applications as a high volume cargo transport and a passenger elevator.

SUMMARY OF THE INVENTION

The self-propelling transport of this invention is designed to enable its incorporation in environments that demand the vehicle be displaced on a path that is primarily but not entirely vertical in direction. Particularly where tall building designs are proposed that for structural reasons do not require a central core. Customarily the elevators systems for accessing upper floors is placed in the central core. Buildings exceeding a hundred floors have already been built and buildings exceeding two hundred floors are being proposed. In such super-high skyscrapers, often with ground floor areas that cover multi blocks, centralized elevator systems are not desirable or practical. Additionally, many of the modern designs are built on perimeter structural designs. These designs leave open interior zones, particularly at the ground levels, where dramatic open-air restaurants and malls are located. External facades that are not vertical but which are conical, pyramidal or curved add additional complexities to the incorporation of effective passenger transport systems that efficiently service all parts of the building.

The self propelling, multi-core transport of this invention is designed to utilize a vehicle unit that is connected to a track unit that can be oriented in any inclination desired by the systems designer. The transport includes a bogie including a chassis with wheels that contact a guide track on the track unit and a sprocket system to engage a continuous chain incorporated into a rail assembly in the track unit. A drive engine in the bogie propels the bogie along the track. The drive engine is preferably in one or more electric motors that are variable in speed and are connected to sprockets of a tracking assembly that in turn are connected to the continuous chain of the rail assembly. The design of the transport is such that the drive chain is lifted from the track, wrapped around a sprocket system to securely engage the vehicle unit to the track unit. In this manner the versatility of the system is substantially improved over other systems and permits the actual variations in the orientation of the guide track to be instituted without sacrifice in the safety of operation.

The bogie can include a container or cargo compartment as a unitary part of carriage of the transport unit. In this arrangement the primary unique feature of the invention is the use of a track system having incorporated therein a continuous stationary chain that is engaged by a movable vehicle.

In the preferred embodiment, however, the bogie includes an appended cab or compartment that is suspended from the bogie in a pendulum manner. In order to inhibit pendulum-like motion initiated during accelerations or decelerations, the cab is equipped with a gyroscope wheel. The gyroscope wheel maintains the cabs vertical orientation with reference to the ground regardless of the inclination of the track or the movement of the bogie.

As part of this invention is a scheme for incorporation of a transport in a multi story structure utilizing a circuitous path for travel on one or more transport units. Additionally, the transport of this invention includes a feature allowing the vehicle units to be integrated or removed from the transport system. These and other features of the invention are described in greater detail in the detailed description of the preferred embodiments described hereafter.

BRIEF DESCRIPTION OF THE DRAWINGS

FIG. 1 is a perspective view of the transport including a vehicle unit and a part of the track unit.

FIG. 5 is a from elevational view of a part of the vehicle unit of FIG. 3.

FIG. 14 is a schematic illustration of a building incorporating the transport of FIG. 1 in a multi-route elevator system.

FIG. 15 is a schematic illustration of a cross section of the building of FIG. 14 showing a transfer route.

FIG. 16 is an schematic illustration of a continuous route of a typical transport in the building of FIG. 14.

DESCRIPTION OF THE PREFERRED EMBODIMENTS

Figure 3:
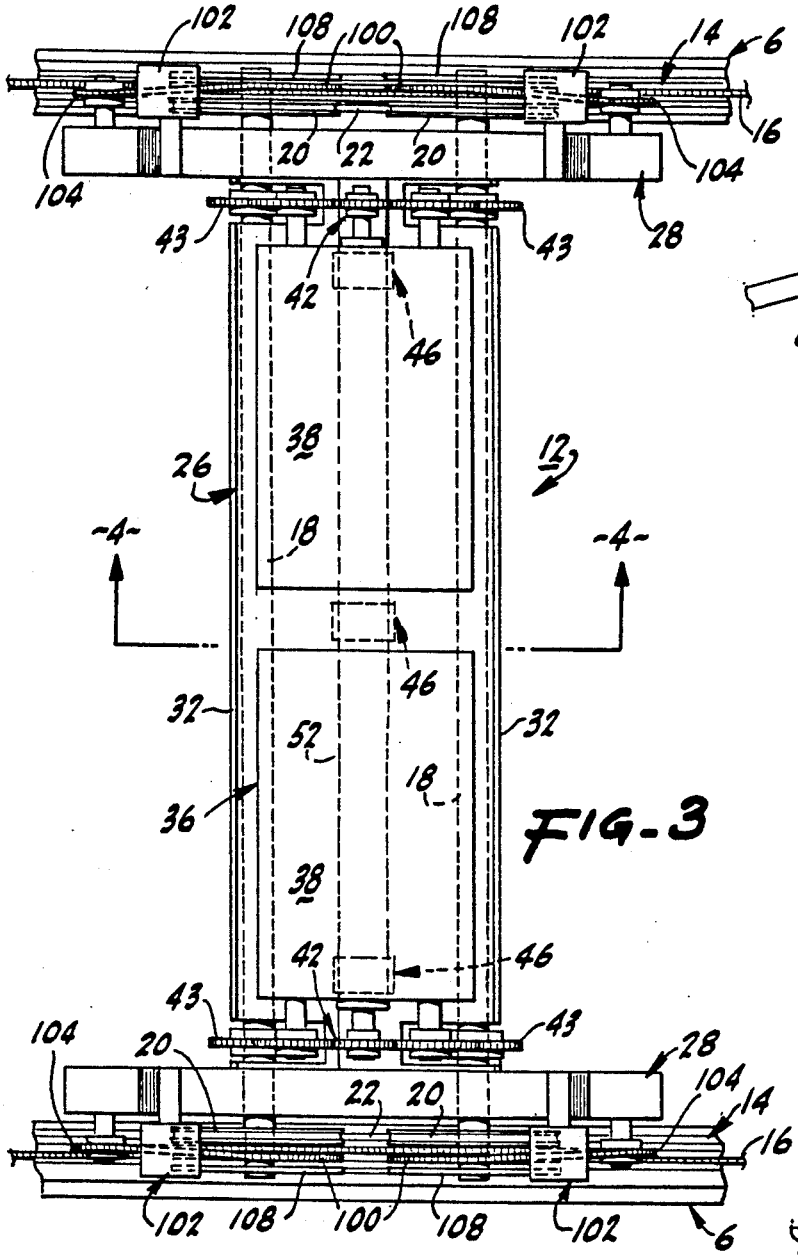
FIG. 3 is a top plan view of a part of the vehicle unit of the transport of FIG. 1.

The self-propelling, multi-route transport of this invention is shown in part in FIG. 1 and designated generally by the reference numeral 2. The transport 2 is a hybrid track/suspension system that combines a vehicle unit 4 with a track unit 6. The transport 2 includes a bogie 12, a track 14 and a linear drive chain 16. The bogie 12 has a pair of axles 18 on the ends of which are mounted guide wheels 20. The guide wheels 20 engage a raised hard rubber or plastic guide track 22 mounted on the surface on each of the two spaced main rails 14 that form the track unit 6.

The axles 18 of the bogie 12 are appropriately mounted in a carriage 26. The carriage 26 includes opposed side members 28 supporting a chain tracking assembly 30 and cross members 32 that span the two tracking assemblies 24 and provide a bed 34 on which is mounted a drive device 36 as shown in FIG. 1. The preferred drive device 36 comprises a pair of electrical motors 38 with suitable transmission means 40 to engage the tracking assemblies 24 and propel the bogie 12 in any of a variety of inclinations. The transmission means 40 of this embodiment comprises a suitable gear train 42 that includes a complimentary drive gear 43 on each of the axles 18 of the bogie. Preferably, two motors are used in tandem to maximize the safety of operation in the event of a failure in one of the two motors. Other drive devices such as linear motors, or combustion engines can be used where appropriate to the environment of use of the described system.

The carriage 26 supports a cage 44, that in the preferred use of the transport 2, comprises an elevator compartment. In other embodiments of the invention the cage 44 may comprise a cargo container, hoist or other utilitarian structure.

Figure 2A:
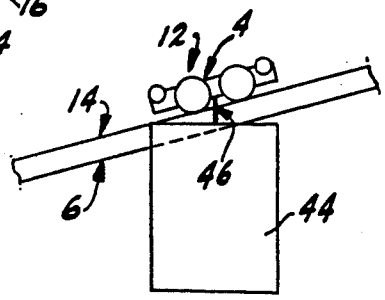
FIG. 2A is a schematic view of the transport of FIG. 1 at an incline angle of the track unit.
Figure 2B:
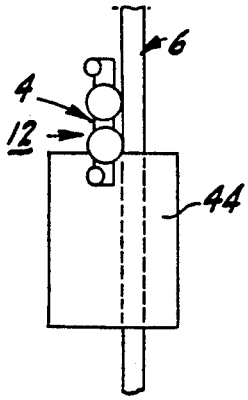
FIG. 2B is a schematic view of the transport of FIG. 1 at a vertical angle of the track unit.
Figure 2C:
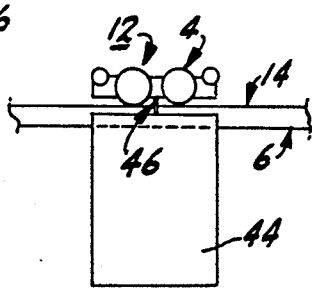
FIG. 2C is a schematic view of the transport of FIG. 1 at a horizontal angle of the track unit.

As shown in FIGS. 2A to 2C, the cage 44 of the vehicle unit 4 has a suspension assembly 46 that pivotally connects the cage 44 to the bogie 12. In FIG. 2A, the bogie 12 is moving along an incline track 14 with the cage 44 maintained in a vertical position between the spaced rails 24, one of which is not shown for schematic clarity. As shown in FIG. 2B, the bogie 12 is tracking on a vertically oriented track 14 with the cage 44 vertically positioned and suspended between the two tracks. In FIG. 2C, the bogie is tracking on a horizontal track 14, again with the cage 44 suspended between the rails 24 in a vertical position.

Figure 4:
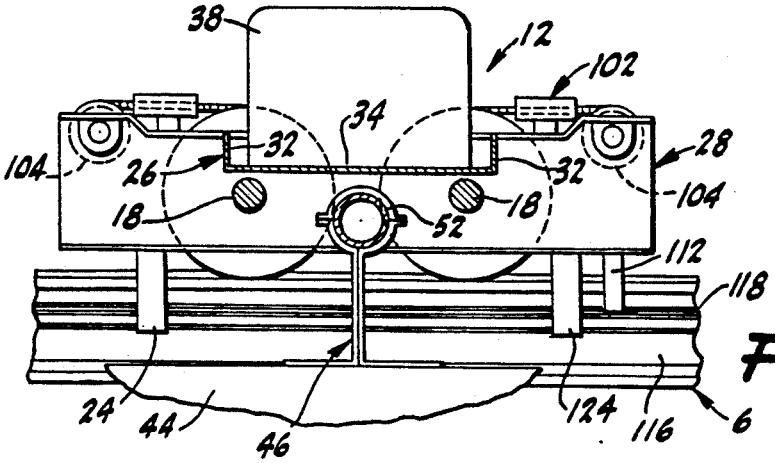
FIG. 4 is a cross sectional view taken on the lines 4—4 in FIG. 3.
Figure 6:
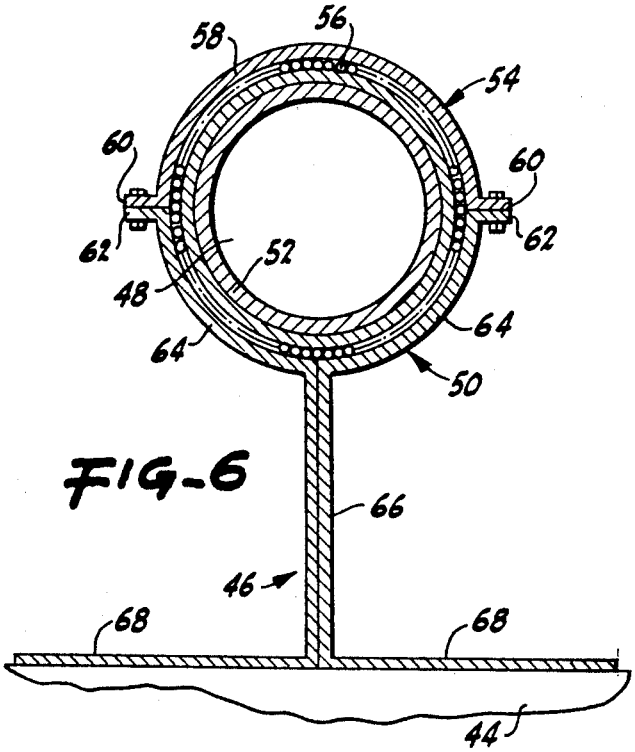
FIG. 6 is an enlarged partial view taken on the line 6—6 in FIG. 5.

Referring now to FIGS. 3 to 5, the suspension assembly 46 for supporting the cab 44 suspended below the bogie 12 is shown. The suspension assembly 46 includes a journal 48 supported between the side members 28 of the carriage 26 between the wheel axles 18. The suspension assembly 46 includes three spaced hangers 50 which, as shown in the detail FIG. 6, includes an inner sleeve 52 and an outer three piece collar 54 between which is contained a ball bearing raceway 56. The three piece collar 54 includes a semi-circular crown segment 58 with end flanges 60 that couple to complimentary end flanges 62 on pair suspension segments 64. The suspension segments 64 in part encompass the sleeve 52 and raceway 56 and in part have a suspension segment 66 to distance the cab 44 from the bogie 12. The suspension segments 64 also have bracket portions 68 that are secured to the top of the cab. The suspension assembly 46 allows the cab 18 to be pivotally suspended from the bogie 12 to permit the cab to remain vertical at the various angle of inclination as illustrated in FIGS. 2A through C.

Figure 7:
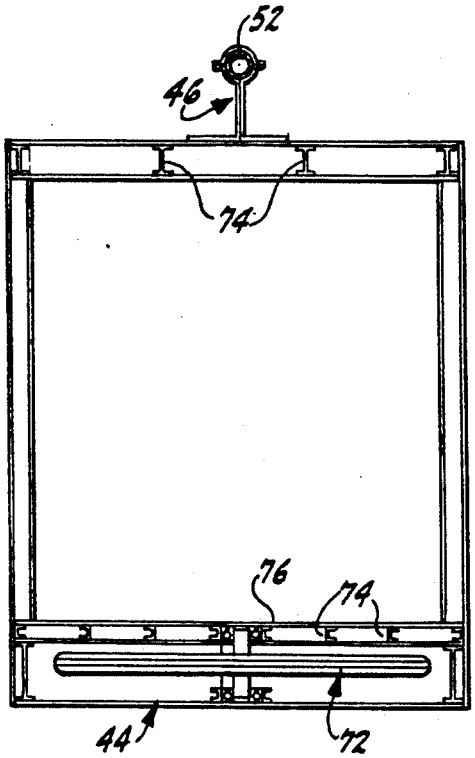
FIG. 7 is a cross sectional view of the cab of the vehicle unit taken on the lines 7—7 of FIG. 1.

To maintain the stability of the cab and prevent a back and forth pendulum motion on starting and stopping, the cab, as shown in FIG. 7 is constructed in with a gyroscope 72 operationally located under the floor 74 of the cab. The gyroscope 72 is driven by a small motor (not shown) and is of sufficient size and weight to inhibit any oscillatory motions imparted to the cab during accelerations, decelerations or shifts in the loading of the cab. As shown in FIG. 7, the cab 44 is constructed of beams 74 and panels 76 and in its preferred use as a passenger cab is constructed in a similar manner to conventional office elevators.

A unique means is used to propel the transport in an environment that will encounter variations in track orientation or in which conventional cable systems ar unusable because of the vertical distance of travel. This means comprises a chain tracking system 78 as shown generally in FIGS. 1 and 8 and in greater detail in FIGS. 9 and 10.

As shown in FIG. 1, the track unit 6 includes a track bed 79, which may be fabricated from concrete and incorporated into the structure of the facility, for example a building, that utilizes the transport system. The track bed 79 is in the form of structural members in the form of the two spaced main rails 24. The rails 24 of the track 14 are spaced sufficiently apart to enable the cab to pivot into the space between the tracks upon inclined or vertical tracking. The structural support rails 24 include the smooth guide track 22 for the guide wheels 20 of the bogie 12. In addition, the support rails 24 of the track unit 6 include a chain guide assembly 80 shown in detail in FIGS. 9 and 10 for retaining the drive chain 16 in a retention channel 82 of a ferro magnetic guide 84.

The ferro magnetic guide 84 is constructed with a continuous, electro magnitizable rail 86 and a series of guide segments 88 connectable to the magnitizable rail 86 by a displaceable bridge segment 90 that is biased against a raised portion 92 of the rail 86 and a raised portion 94 of the series of guide segments 88 by a compression spring 96. The magnetizable rail 86 is magnetized by a series of electromagnetic coils 96 that are mounted to the rail of the ferro magnetic guide 84 and induce a magnetic effect into the rail and into the discreet guide segments 88 when bridged by the displaceable bridge 90. In this manner the drive chain 16 which is made of a magnetizable material, preferably steel, is retained securely into the retention channel 82 of the chain guide assembly 80. Because the power of the electromagnetic force in retaining the drive chain is of sufficient strength to maintain the chain in the track together with the weight and inertial force of the bogie 12 and cab 44, the displaceable bridge 90 provide a means for releasing the substantial magnetic force when the chain is lifted from the retention channel 82 by a chain tooth drive wheel 100 mounted in conjunction with each guide wheel 20 of the bogie 12.

As shown in FIG. 1, the drive chain 16 is picked up by one pair of drive wheels 100, laterally displaced by a chain aligner 102, wrapped around one of two chain-tooth idler wheels 104, which redirect the drive chain 16 to the companion drive wheel 100, which lays the chain back into the retention channel 82. The function of the drive wheel 100 in picking up or laying down the drive chain 16 depends, of course, on the direction that the bogie is traveling. The wrap around configuration of the drive chain securely weds the transport bogie 12 to the track 14.

Figure 8A:
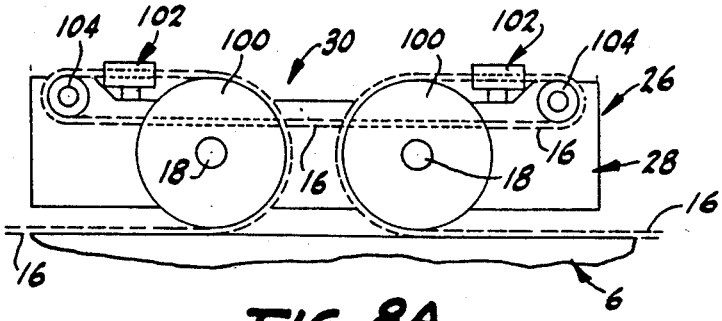
FIG. 8A is a side view schematically illustrating the preferred arrangement of the chain tracking assembly.
Figure 8B:
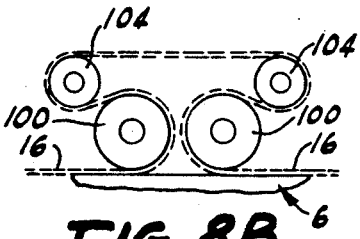
FIG. 8B is a schematic view of an alternate chain tracking assembly.
Figure 11:
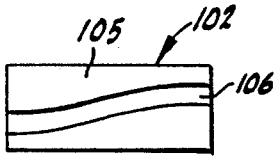
FIG. 11 is an enlarged view of the underside of the chain aligner of the vehicle unit of FIG. 8.
Figure 8C:
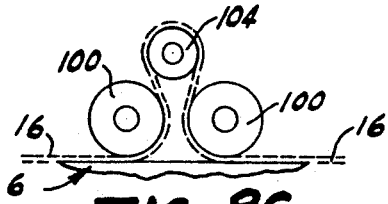
FIG. 8C is a schematic view of a further alternate chain tracking assembly.

Each of the four chain aligners 102 has a guide member 105, as shown in greater detail in FIG. 11 with a chain groove 106 that displaces the drive chain 16, enabling the drive chain to pass between the chain tooth drive wheel 100 and the guide wheels 20 as shown in FIG. 8. Alternately, by routing the chain under and then over slightly raised guide wheels, the chain displacement can be avoided and the aligners omitted. Schematic illustrations of alternate routing schemes are shown in FIGS. 8*a* and 8*b*.

Figure 9:
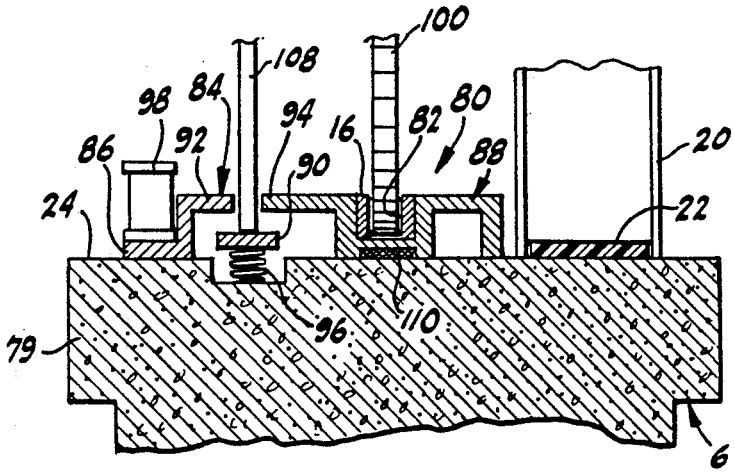
FIG. 9 is an enlarged partial cross sectional view of the transport of FIG. 5 detailing a part of the vehicle unit and track unit.
Figure 10:
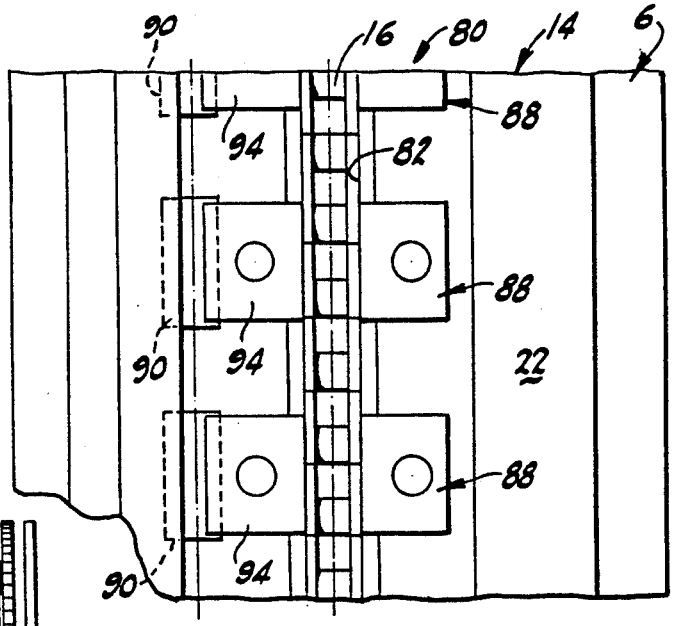
FIG. 10 is an enlarged partial plan view of the track unit of FIG. 9.

Included in the chain guide assembly 80 of the vehicle unite 4 are disconnector discs 108 that are fixed to the axles 18 of the bogie 12 and are mounted adjacent the chain drive wheel 100. The disconnector disc 108 as shown in FIG. 9 engage the space between the raised portion 92 of the magnetized rail 86 and the raised portion 94 of the guide segments 88. The disconnector discs 108 contact the bridge 90 and displace the bridge from the remaining part of the magnetic guide 84 disconnecting the magnetic induction of the guide segments 88 that are holding the chain engaged by the chain drive wheel 100. In this manner the segment is no longer magnetized and the chain can be easily lifted from the retention channel 82 on rotation of the drive wheel 100 as the bogie is displaced along the track 14.

It may be advantageous that a permanent magnet 110 be incorporated into the guide segments 88 to retain the chain with sufficient force to support the weight of the chain without impeding in any significant manner the ability of the chain to be lifted from the guide segments 88 as the transport passes. In this manner the entire system of guide segments 88 need not be electro magnetized and only stretches in the vicinity of the passing bogie need be activated in a manner similar to the design of magnetic levitation train systems. Furthermore, if the electromagnetic system 96 for magnetizing the magnetizable rail 86 is of a high intensity type used in magnetic propulsion systems, the electric motors 38 can be of a linear type for propelling the bogie 12 by interfering magnetic fields. These systems are in the experimental and development stages in Germany and Japan and such propulsion systems are adaptable to the transport of this invention. The power is delivered to the bogie to drive the drive motors and power the other functions of the transport unit 8 by electrical slide brushes 112 on each side of the bogie carriage 26 as shown in FIGS. 4 and 5 which contact a continuous power supply track 118.

Figure 13:
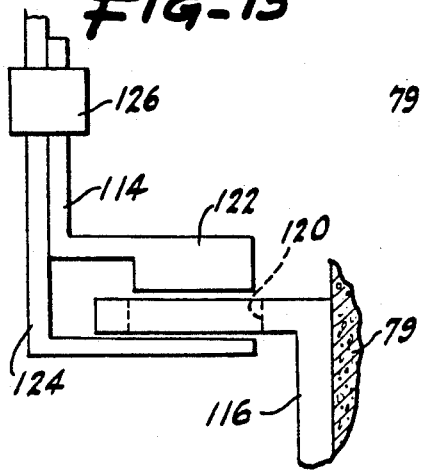
FIG. 13 is an enlarged partial view of the safety latch assembly of FIG. 12.
Figure 12:
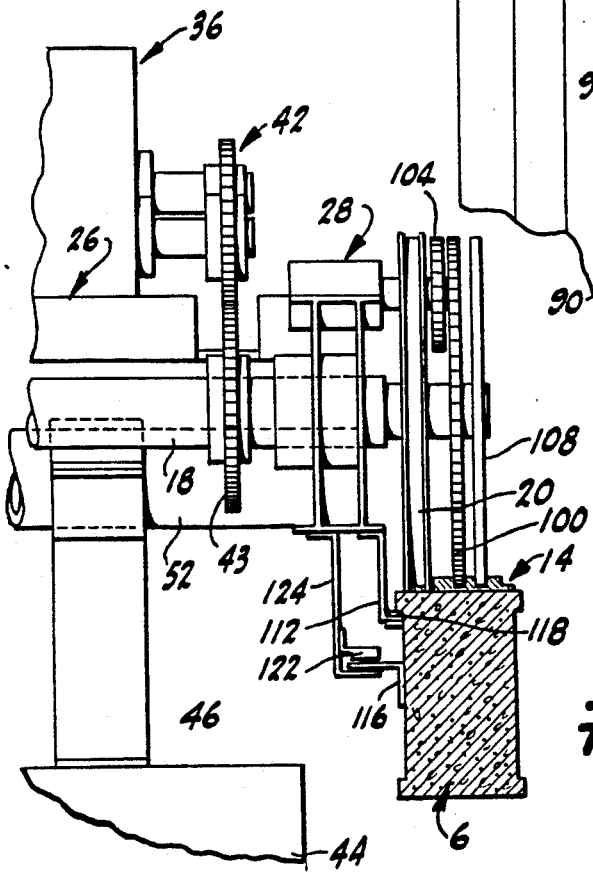
FIG. 12 is an partial view of the transport illustrating a safety latch assembly.

In the event of power failure, the transport unit is retained in position against the track unit by a safety detent 114 shown in FIGS. 4 and 5 and in greater detail in FIGS. 12 and 13. Referring to FIG. 12 the support track 14 includes a safety rail 116 located immediately below the continuous power track 118. The safety rail 116 includes a series of rectangular slots 120 that are engageable by a displaceable latch 122 on the safety detent 114. The latch 122 is slidably engageable with to a support member 124 and retained in an elevated position by solenoid coil 126 activated by power from the power source. Upon cessation of power the latch 122 drops by gravity into one of the slots 120 in the safety rail with minimal slippage of the vehicle unit 4 on the track unit 6.

In the preferred use of the transport, the system is installed on a building of such heights that the very weight of conventional suspension cables for elevators systems are of such magnitude that a continuous, full service height, suspended elevator system is impractical. Additionally, the transport of this invention is advantageously used in a building of such design that the preferred route of an elevator system is not vertical but may follow a path that is coincident with the building profile.

As shown in FIGS. 14 and 15, a tall building 128 having well over a hundred floors serviceable by an elevator system may use service schemes incorporating the transport of this invention as schematically shown in FIGS. 14 through 18.

As shown in FIG. 14, a multi-story building 128 with approximately one hundred fifty floors is shown that is nozzle-like in configuration with a circular cross-section. This configuration is structurally sound and aesthetically pleasing but provides certain difficulties in design of an effective internal transportation system. Since the footprint area of the building can be substantial, a core elevator system may be inappropriate and a perimeter access preferred. As shown in the schematic illustration of FIG. 14, a plurality of different routes can be established to reach intermediate and upper floors. For example, the route 130 as indicated in the solid line reaches the upper floors where local stops, indicated by dotted line, can be accomplished.

Similarly, as indicated by routes 132 the intermediate floors can be reached by an express portion of the route shown in solid line and a local floor by floor portion shown in dotted line. To maximize the capacity of the system, a plurality of transport units as suggested by the multiple individual arrows 134 can be included in the system since the system can be continuous and circuitous in nature as shown by the exemplar route 136 in FIG. 16. Depending on where an individual wishes to exit, a transfer route system can be established at the upper floor of the intermediate route or upper route as shown in FIG. 15.

Figure 18:
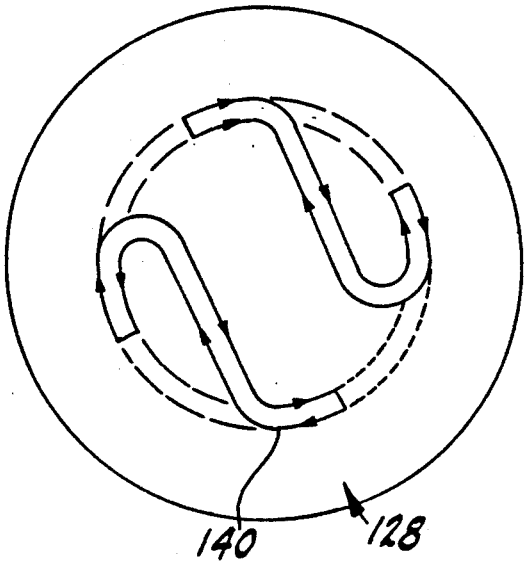
FIG. 18 is a schematic illustration of a cross section of the building of FIG. 17 showing a transfer route.
Figure 17:
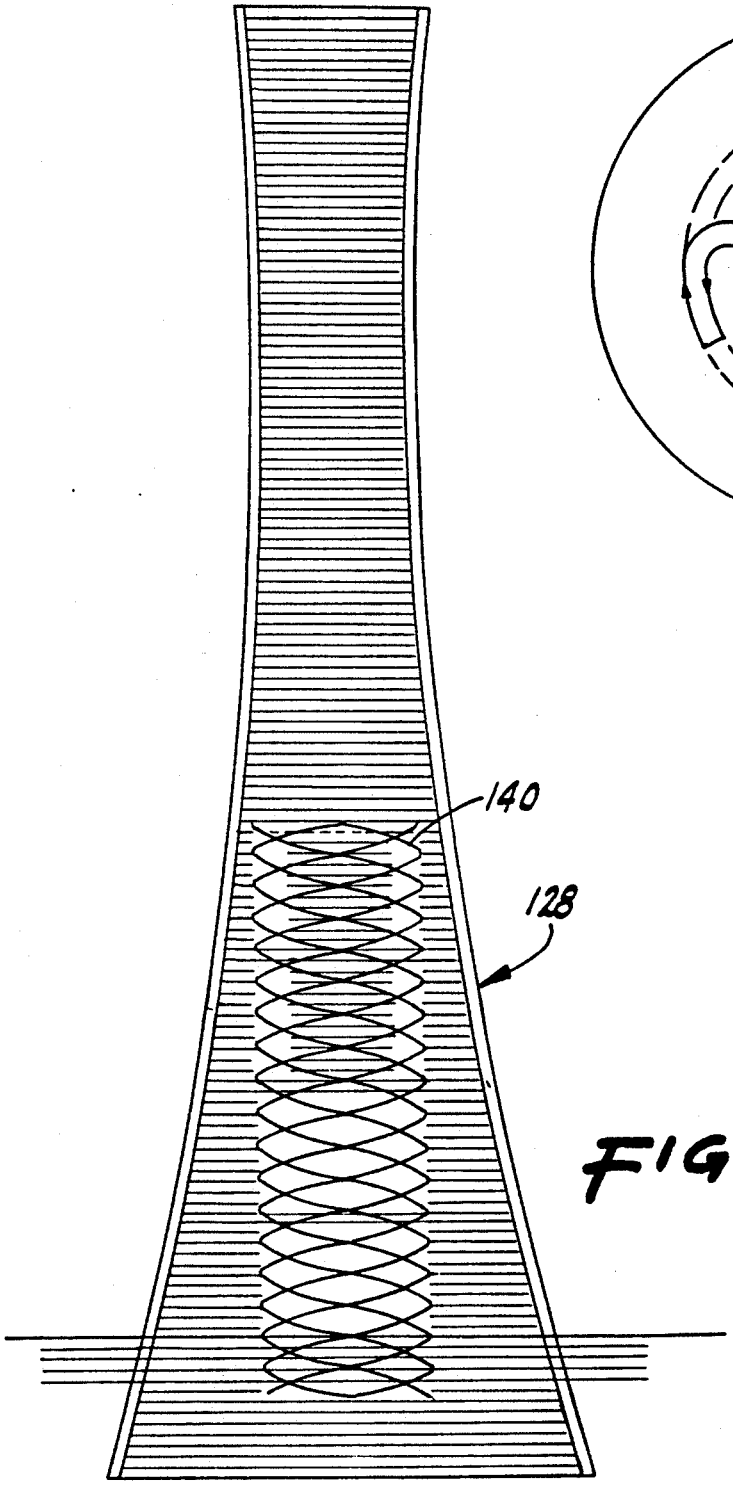
FIG. 17 is a schematic illustration of a building incorporating the transport of FIG. 1 in a alternate multi-route elevator system.

Although a similar local system can be used for the lower floors an alternate system such as shown in FIGS. 17 and 18 may be utilized. The building 128 includes a spiral tracking system that may be installed within an open central concourse area within the building as is frequently utilized for dramatic effect. A cab can take a helical path 140 as shown in FIG. 17. At the top and bottom floors the individual transfer such that each of the four primary access corners of the building 128 can be serviced as shown in FIG. 18.

Figure 19A:
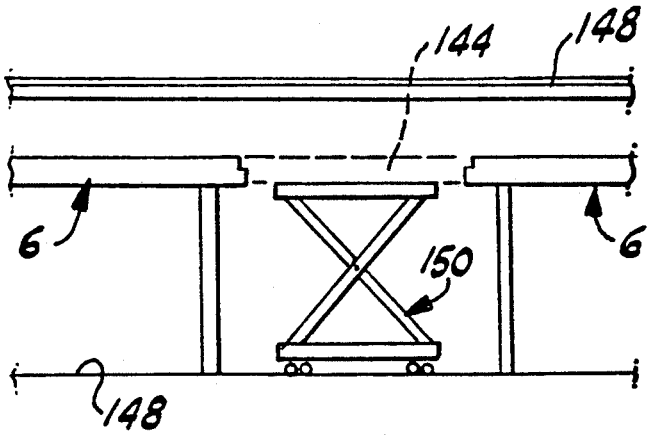
FIG. 19A is a schematic illustration of a step in the insertion of transport unit onto the track unit.
Figure 19B:
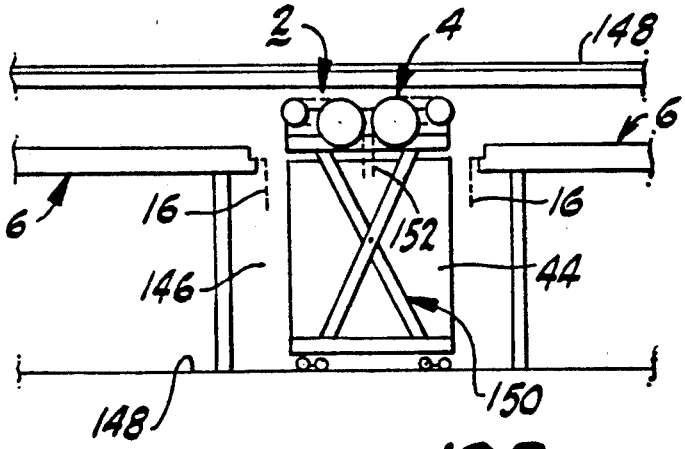
FIG. 19B is a schematic illustration of further step in the insertion of a transport unit onto a track unit.
Figure 19C:
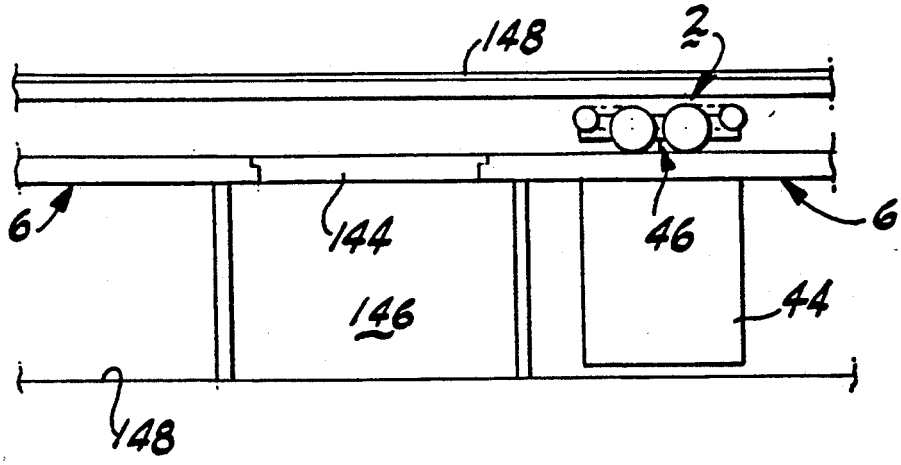
FIG. 19C is a schematic illustration of a final step in the insertion of a transport unit onto a track unit.

Since the route of the transport is continuous, means for inserting or removing transport units is provided in a service zone as shown in FIGS. 19A, 19B and 19C. As shown in FIG. 19A a track section 144 in a service area 146 between floors 148 is removed by a scissors lift 150. As shown in 19B the drive chain 16 is disconnected to permit a vehicle unit 8 with cab 44 and coupled bogie 12 to be positioned in place by the scissors lift 150. The bogie includes a drive chain segment 152 that is of predefined length to splice into the existing drive chain 16 to maintain the integrity of the drive chain without slack. The vehicle unit 8 is moved to the side as shown in FIG. 19C and the track segment 144 replaced.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A self-propelling transport comprising: a track unit having two spaced rail members with a continuous drive chain retained on at least one of the rail members;

a vehicle unit having a carriage with wheels with means for maintaining the vehicle unit on the track unit at inclinations of the carriage from horizontal to vertical, wherein at least one of the wheels is a chain engagement wheel having sprocket teeth engaging the continuous drive chain;

active retention means for actively retaining the drive chain on the rail member at inclinations of the rail member from horizontal to vertical;

release means for selectively releasing a segment of chain from the rail member proximate the chain engagement when by deactivating the retention means, wherein the chain segment is wrapped in part around the chain engagement wheel; and, propulsion means on the carriage operably connected to the chain engagement wheel for moving the vehicle unit along the track unit.

2. The transport of claim 1 wherein the rail members each include a guide track and the carriage includes a plurality of guide wheels that engage the guide tracks and support the vehicle unit on the rail members.

3. The transport of claim 2 wherein the rail members include a drive chain on each of the two spaced rail members, and wherein the carriage includes a plurality of chain engagement wheels on each rail member engagable with each drive chain.

4. The transport of claim 1 wherein the vehicle unit includes a chain tracking assembly including a plurality of chain engagement wheels with one chain engagement wheel mounted on the carriage and positioned proximate the rail member to engage the chain and lift the chain from the track, one chain engagement wheel mounted on the carriage and positioned proximate the rail member to engage the chain and return the chain to the track, and at least one chain idler wheel mounted on the carriage and positioned displaced from the rail member partly around which the chain is tracked, wherein the idler wheel comprises in part the means to maintain the carriage against the track unit.

5. The transport of claim 4 wherein the rail members include a drive chain on each of the two spaced rial members, and wherein the vehicle unit has a pair of chain tracking assemblies on each side of the carriage, each assembly engaging a separate drive chain.

6. The transport of claim 5 wherein each chain tracking assembly includes a pair of spaced idler wheels and wherein each chain is wrapped partly around both of the spaced idler wheels.

7. The transport of claim 6 wherein the idler wheels are displaced from alignment with the engagement wheels and the tracking assembly includes an alignment mechanism to align the drive chains onto the idler wheels and engagement wheels.

8. The transport of claim 1 wherein the means for actively retaining the drive chain comprises a magnetizable rail mechanism along at least one of the rail members against the drive chain, wherein the drive chain is fabricated of a magnetizable material and is magnetically retained against the rail mechanism when the rail mechanism is magnetized.

9. The transport of claim 8 wherein the release means for selectively releasing a segment of chain comprises means in said magnetizable rail mechanism for selectively withholding magnetization of a segment of the rail mechanism proximate the chain engagement wheel and magnetizing the rail mechanism displaced from the engagement wheel, wherein the chain engagement wheel wraps the chain in part around the wheel without encountering the retention force of the retention means.

10. The transport of claim 8 wherein the magnetizable rail mechanism for retaining the drive chain includes a continuous magnetizable rail element mounted on one of the rail members having a series of magnet elements thereon, a continuous series of discrete spaced magnetizable guide segments, each having a chain receiving groove, the guide segments being positioned adjacent, and displaced from the magnetizable rail element and having a displacable bridge segment associated with each guide segment, and, disengagement means proximate the chain engagement wheel for displacing discrete bridge segments as the vehicle unit passes.

11. The transport of claim 10 wherein the means for displacing the discrete bridge segments comprises a rotating disconnector disc mounted adjacent the chain engagement wheel and bias means on the bridge segments for biasing the bridge segment in contact with the rail element.

12. The transport of claim 11 wherein the magnet elements comprise a series of electromagnets and the transport includes a power source, the electromagnets being magnetized by the power source.

13. The transport of claim 11 wherein the propulsion means of the vehicle unit comprises an electric motor, and wherein the track unit includes a power track and the vehicle unit includes a slide contact means that contacts the power track and is electrically connected to the electric motor for powering the motor and driving the vehicle unit.

14. The transport of claim 1 wherein the vehicle unit includes a cab connected to the carriage, and the cab has a pivotal suspension assembly connecting the cab to the carriage wherein the cab is suspended by the suspension assembly between the two spaced rail members of the track unit.

15. The transport of claim 14 wherein the suspension assembly includes a journal on the carriage and a hanger on the cab with a collar having a ball bearing assembly encompassing the journal.

16. The transport of claim 14 wherein the cab includes an orientation means comprising a weighted wheel of sufficient size to inhibit any oscillatory motions imparted to the cab during operation.

17. The transport of claim 1 having further a safety detent wherein one of the rail members of the track unit includes a safety rail with a series of spaced slots and the vehicle unit includes a detent engagable with the spaced slots of the safety rail.

18. The transport of claim 1 in combination with a building structure wherein the track unit is installed in the building structure with a continuous circuitous route with portions of the route being horizontal at upper and lower portions of the route and vertical at intermediate portions of the route.

19. The transport of claim 1 in combination with a building structure wherein the track unit is installed in the building structure with a continuous circuitous route with portions of the route being horizontal at upper and lower portions of the route and helical at intermediate portions of the route.

20. The transport of claim 1 in combination with a building structure wherein the track unit is installed in the building structure with a continuous circuitous route with a service zone wherein a segment of each of the rail members is removable and a part of the drive chain is separable for installation of vehicle units.

* * * * *